US007862490B2

(12) United States Patent
Glynn

(10) Patent No.: US 7,862,490 B2
(45) Date of Patent: Jan. 4, 2011

(54) EXERCISE MACHINE FORCE APPLICATION APPARATUS

(76) Inventor: Sean Glynn, 2202 Newfield La., Austin, TX (US) 78703

( * ) Notice: Subject to any disclaimer, the term of this patent is extended or adjusted under 35 U.S.C. 154(b) by 186 days.

(21) Appl. No.: 12/220,735

(22) Filed: Jul. 28, 2008

(65) Prior Publication Data

US 2010/0022360 A1 Jan. 28, 2010

(51) Int. Cl.
*A63B 21/00* (2006.01)
*A63B 21/062* (2006.01)

(52) U.S. Cl. ..... 482/137; 482/100; 482/133

(58) Field of Classification Search ..... 482/77, 482/79, 80, 100, 111, 122, 123, 129, 136, 482/137, 146; 601/29, 148
See application file for complete search history.

(56) References Cited

U.S. PATENT DOCUMENTS 1,665,969 A * 4/1928 McNamara ..... 482/90
4,204,675 A * 5/1980 McGinnis ..... 482/80
5,131,897 A 7/1992 Krieger
5,169,363 A * 12/1992 Campanaro et al. ..... 482/96
5,186,700 A * 2/1993 Wang ..... 482/111
5,267,923 A * 12/1993 Piaget et al. ..... 482/53
5,441,466 A * 8/1995 Piaget et al. ..... 482/52
5,549,533 A 8/1996 Olson
5,628,715 A 5/1997 Simonson
5,762,590 A 6/1998 St. Fleur
5,851,166 A 12/1998 Bernardson
5,897,474 A 4/1999 Romero
6,029,962 A 2/2000 Shorten
6,127,010 A 10/2000 Rudy
6,146,343 A * 11/2000 Stewart ..... 601/118
6,413,197 B2 7/2002 McKechnie
6,478,721 B1 * 11/2002 Hunter ..... 482/140
6,571,490 B2 6/2003 Tawney
6,705,975 B2 * 3/2004 Kuo ..... 482/79
6,811,523 B1 11/2004 Timmer
7,074,164 B2 * 7/2006 Moring et al. ..... 482/112
7,112,168 B2 9/2006 Dalebout
7,131,934 B2 11/2006 Dadbeh
7,357,767 B2 4/2008 Tsai
7,364,534 B2 4/2008 Zoller et al.
7,604,581 B1 * 10/2009 Williams ..... 482/140
7,614,978 B2 * 11/2009 Piaget et al. ..... 482/53
2004/0023766 A1 2/2004 Slone
2006/0160673 A1 * 7/2006 Tennant et al. ..... 482/91
2007/0275832 A1 * 11/2007 Goldman et al. ..... 482/77
2008/0046284 A1 2/2008 Fisher

* cited by examiner

*Primary Examiner*—Loan Thanh
*Assistant Examiner*—Allana Lewin
(74) *Attorney, Agent, or Firm*—David O. Simmons

(57) ABSTRACT

An exercise machine has a reactant force generating mechanism and a force application device. The force application device is coupled to the force input structure of the reactant force generating mechanism and is configured for transmitting force generated by a user to the force input structure. At least a portion of the force application device protrudes from within an opening in the force input structure. The force application device includes a non-compliant base portion, a compliant outer shell coupled to the base portion and pressure displaceable material contained within an interior space of the compliant outer shell. The force application device allows the user-generate force to be transmitted through the pressure displaceable material and exerted on the reactant force generating mechanism of the exercise machine so as to cause the force input structure to exert a proportional reactant force on the force application device.

17 Claims, 3 Drawing Sheets

EXERCISE MACHINE FORCE APPLICATION APPARATUS

FIELD OF THE DISCLOSURE

The disclosures made herein relate generally to exercise machines and, more particularly, to exercise machines configured for causing stabilizing muscles to be exerted during exercise of corresponding mover and core muscles.

BACKGROUND

Many athletes and non-athletes utilize weight-training exercises to build strength and/or bulk, to prevent injury, to recover from injury and/or to improve overall condition and appearance. Over the past several decades or so, exercise machines of various types and configurations have been designed for facilitating such weight training exercises. Exercise machines have been developed for many different purposes. Exercise machines can be specifically configured for use in the home, in health clubs, in physical therapy environments or the like. More specifically, exercise machines can be configured to exercise several different parts of a body (e.g., most exercise machines configured for use in the home) or can be configured to provide exercise that is targeted at a specific muscles group (e.g., legs, chest, arms, back, etc.) Examples of such muscle group specific exercise machines (i.e., those typically used in health clubs and physical therapy environments) include leg presses, bench presses, arm curl machines, squat machines and the like.

The ability to exercise mover muscles, which are large muscles and/or muscle groups that exert force in a manner that exhibit strength, is one design consideration of nearly all exercise machines. Predominant (e.g., large) muscles within muscle groups commonly referred to as quadriceps, hamstrings and the calves are examples of mover leg muscles. Muscles within muscle groups commonly referred to as biceps, triceps and deltoids are examples of mover arm muscles. Rotator cuff muscles and hip joint muscles are examples of stabilizer muscles. In some respects, it is an easy task to design an exercise machine to activate such mover muscles. For example, force application devices such as bench press hand gripping members, leg press foot platens, and the like, which maintain a machine designated orientation while force is being exerted thereon, result in mover muscle groups being readily activated during force exertion. The exercise machine controls and/or stabilizes placement of the force application device during force application, which causes mover muscles to be the primary muscles engaged.

Development of mover muscles is the desired and intended objective of many weight training programs and associated exercises. Such strength training exercise uses resistance to strengthen and condition the musculoskeletal system, thereby improving strength, tone and endurance of mover muscle groups. However, there are instances where it is necessary and/or desirable to activate stabilizer muscles and/or core or bulk muscles that act in a stabilizing manner, as opposed to or in combination with mover and core muscles. For example, in weight training, fitness training and rehabilitation therapy, it is beneficial to activate such stabilizer muscles to strengthen them, develop/redevelop physical coordination and the like. Stabilizer muscles are muscles that provide for alignment and positional control of interconnected skeletal structures such as for example interconnected skeletal structures at the wrists, ankles, hips and shoulders.

Training for neuromuscular stability and coordination is sometimes referred to functional training, balance training, or unstable training, and will be referred to hereinafter as unstable training. It is believed that unstable training (i.e., training with instability within a force application device) challenges the neuromuscular system to a greater extent compared to training on stable (e.g., fixed) platforms. Training with instability within a force application device can increase proprioceptive (i.e., body positioning) demands and stress the core muscles that are important for stability and balance.

Typical strength and power training on a stable surface elicits fast twitch muscle fibers. Because using unstable surface movement requires the movement to be performed in a slower, more controlled manner, these exercises often predominantly target slow-twitch stabilizing and postural muscles. One of the goals of this type of training is dynamic joint stabilization, which refers to the ability of the kinetic chain (muscles, nervous, and skeletal systems) to stabilize a joint during movements. One example of dynamic joint stabilization is the rotator cuff stabilizing the head of the humerus on the glenoid fossa (shoulder blade) while performing a push-up. Another example of dynamic joint stabilization is the gluteus medius (i.e., outer thigh) and adductor complex (i.e., inner thigh) stabilizing the hip when performing a squat. Still another example of dynamic joint stabilization is the posterior tibialis and peroneus longus (i.e., calf muscles and tendons) stabilizing the foot and ankle complex when performing a calf raise.

In research published in the Canadian Journal of Applied Physiology (February 2005, Anderson K, Behm DG) the objective of the study was to determine the differences in electromyographic (EMG) activity of the soleus (SOL=calf), vastus lateralis (VL=outer thigh), biceps femoris (BF), abdominal stabilizers (AS), upper lumbar erector spinae (ULES), and lumbo-sacral erector spinae muscles (LSES) while performing squats of varied stability and resistance. Stability was altered by doing a squat exercise movement on a Smith brand squat machine, a free squat, and while standing on two balance discs. Fourteen male students performed the movements using each of the three exercise protocols. Activities of the SOL, AS, ULES, and LSES were highest during the unstable squat (i.e., on the balance discs) and lowest with the Smith Machine protocol.

Therefore, an apparatus that is configured for causing stabilizer muscles to be selectively activated and exerted during exercise of corresponding core and mover muscle groups would be advantageous, desirable and useful.

SUMMARY OF THE DISCLOSURE

Embodiments of the present invention allow effective and efficient exercise of stabilizer muscles during exercise of corresponding core and mover muscle groups. Conventional exercise machines with fixed force input structures offer only limited activation of stabilizer muscles. Accordingly, exercise machines configured in accordance with the present invention overcome at least one shortcoming of such conventional exercise machines.

In one embodiment of the present invention, an exercise machine comprises a reactant force generating mechanism and a force application device. The reactant force generating mechanism includes a force input structure. The force application device is coupled to the force input structure and is configured for transmitting force generated by a user and applied thereon to the force input structure. At least a portion of the force application device protrudes from within an opening in the force input structure. The force application device includes a substantially non-compliant base portion, a compliant outer shell coupled to the base portion and pressure displaceable material contained within an interior space of the compliant outer shell. The force application device is configured for allowing the force generated by the user and applied on the compliant outer shell to be transmitted through the pressure displaceable material and exerted on the reactant force generating mechanism of the exercise machine so as to cause the force input structure to exert a proportional reactant force on the force application device.

In another embodiment of the present invention, an exercise machine comprises a reactant force generating mechanism and a force application device. The reactant force generating mechanism includes a force input structure configured for having force generated by a user exerted thereon. The force application device is coupled to the force input structure. At least a portion of the force application device protrudes from within an opening in the force input structure. The force application device includes a user contact portion configured for being engaged with a force-exerting appendage of the user and a force transmission apparatus coupled between the reactant force generating mechanism and the user contact portion. The reactant force generating mechanism and the user contact portion are coupled to each other by a compliant outer shell of the force transmission apparatus such that, over an allowable range of motion of the user contact portion with respect to the force input structure, the user must simultaneously apply force on the user contact portion for dictating relative orientation of the user contact portion with respect to the force input structure and for actuating the reactant force generating mechanism of the exercise machine.

In another embodiment of the present invention, a force input structure for an exercise machine. The force input structure has a force application device in combination therewith. The force application device is configured for allowing force generated by a user and applied thereon to be exerted on the force input structure of a reactant force generating mechanism of the exercise machine so as to cause a reactant force generating mechanism of the exercise machine to exert a proportional reactant force on the force application device via the force input structure. At least a portion of the force application device protrudes from within an opening in the force input structure. The force application device comprises a substantially non-compliant base portion, a substantially non-compliant user contact portion and a force transmission apparatus coupled between the base portion and the user contact portion. The substantially non-compliant base portion has a machine interface portion coupled to the force input structure of the exercise machine. The substantially non-compliant user contact portion is configured for being engaged with a force-exerting appendage of the user. The force transmission apparatus includes a compliant outer shell and pressure displaceable material contained within an interior space of the compliant outer shell. The base portion and the user contact portion are coupled to each other by the compliant outer shell such that, over an allowable range of motion of the user contact portion with respect to the force input structure, the user must simultaneously apply force on the user contact portion for dictating relative orientation of the user contact portion with respect to the force input structure and for actuating the reactant force generating mechanism of the exercise machine.

In another embodiment of the present invention, an exercise machine comprises a reactant force generating mechanism, a foot platen and a stabilizer muscle activating force application device. The foot platen is coupled to the reactant force generating mechanism such that force exerted on the foot platen by a user causes the reactant force generating mechanism to exert a proportional reactant force on the foot platen. The stabilizer muscle activating force application device is coupled to the foot platen in a manner whereby the stabilizer muscle activating force application device is accessible by the user when the user is in a use position with respect to the foot platen. At least a portion of the stabilizer muscle activating force application device protrudes from within an opening in the foot platen. The stabilizer muscle activating force application device comprises a substantially non-compliant base portion, a substantially non-compliant user contact portion and a force transmission apparatus. The substantially non-compliant base portion engaged with the foot platen. The substantially non-compliant user contact portion is configured for being engaged by a foot of the user. The force transmission apparatus is coupled between the base portion and the user contact portion. The force transmission apparatus includes a compliant outer shell and pressure displaceable material contained within an interior space of the compliant outer shell. The pressure displaceable material includes at least one of gaseous material, granular material and foam material. The base portion and the user contact portion are coupled to each other by the compliant outer shell such that, over an allowable range of motion of the user contact portion with respect to the base portion, the user must simultaneously apply force on the user contact portion for dictating relative orientation of the user contact portion with respect to the base portion and for actuating the reactant force generating mechanism of the exercise machine.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
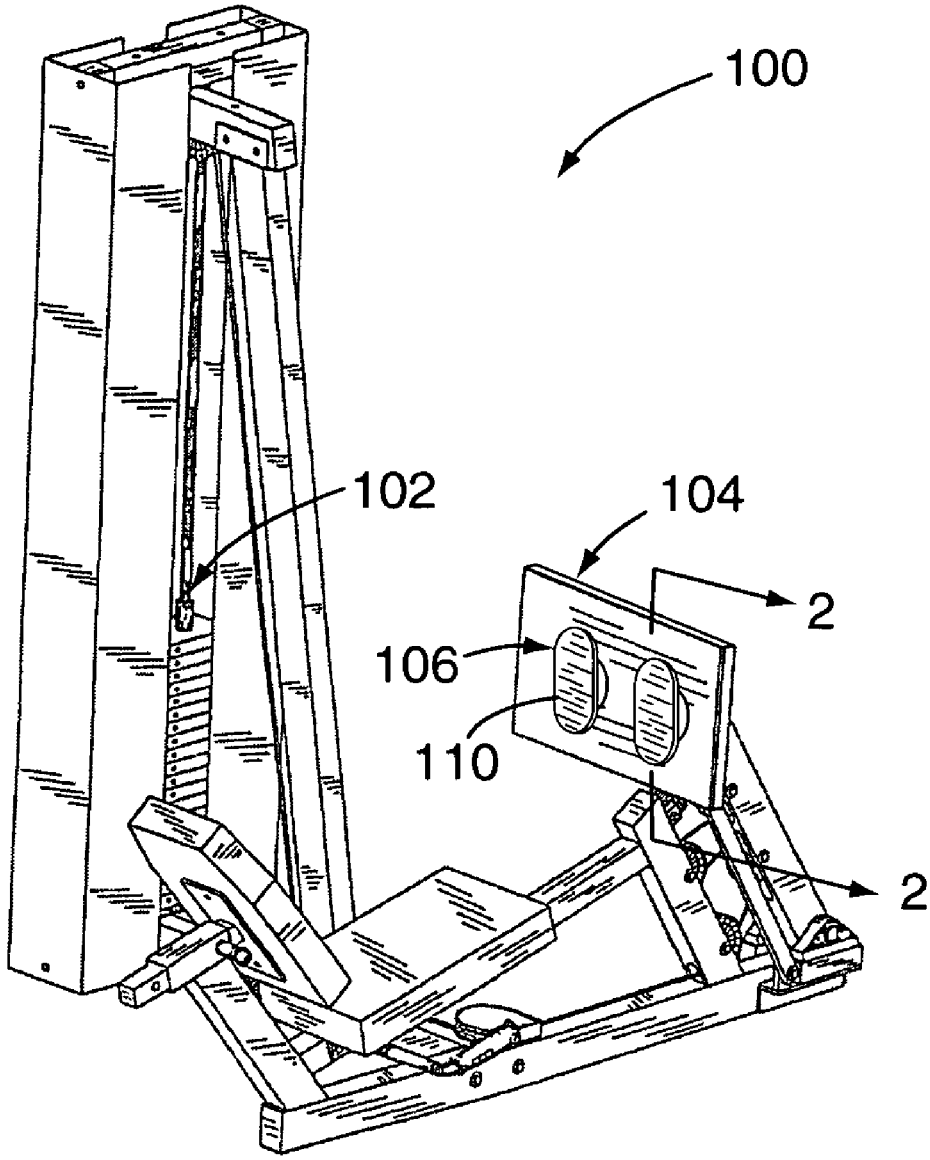
FIG. 1 is a perspective view of a leg press machine configured in accordance with an embodiment of the present invention.

FIG. 1 shows a leg press machine 100 configured in accordance with one embodiment of the present invention. The leg press machine 100 is one example of an exercise machine configured in accordance with the present invention. However, the present invention is not unnecessarily limited to be embodied within any particular type of exercise machine. For example, the present invention can be used in combination with and/or incorporated within home gyms, exercise machines configured solely for exercising the upper body, isometric-type exercise machines, callisthenic-type exercise machines (i.e., including callisthenic type exercise apparatuses) and the like. Accordingly, although a leg press is depicted herein as an exemplary embodiment, a skilled person in the related art(s) will appreciate that any number of other types and configurations of exercise machines and exercise apparatuses can be configured in accordance with the present invention.

The leg press machine 100 includes a reactant force generating mechanism 102, a foot platen 104 and two spaced apart force application devices 106. Each force application device 106 is configured for activating stabilizer muscles in the legs and, thus, is also referred to herein as a stabilizer muscle activating force application device. The foot platen 104 is coupled to the reactant force generating mechanism 102 such that force exerted on the foot platen 104 by a user causes the reactant force generating mechanism 102 to exert a proportional reactant force on the foot platen 104. In this manner, resistance force is exerted on a user by the leg press machine 100.

The force application device 106 is coupled to the foot platen 104 in a manner whereby the stabilizer muscle activating force application device 106 is accessible by the user when the user is in a use position with respect to the foot platen 104. In the depicted embodiment, the reactant force generating mechanism 102 includes, but is not limited to, a plurality of one or more weights, one or more cables and one or more pulleys. A skilled person will appreciate that an exercise machine configured in accordance with the present invention is not limited to any particular type or configuration of mechanism that develops and exerts a proportional reactant force in response to being activated (e.g., displaced) by a force exerted on the mechanism by a user of the exercise machine.

Figure 2:
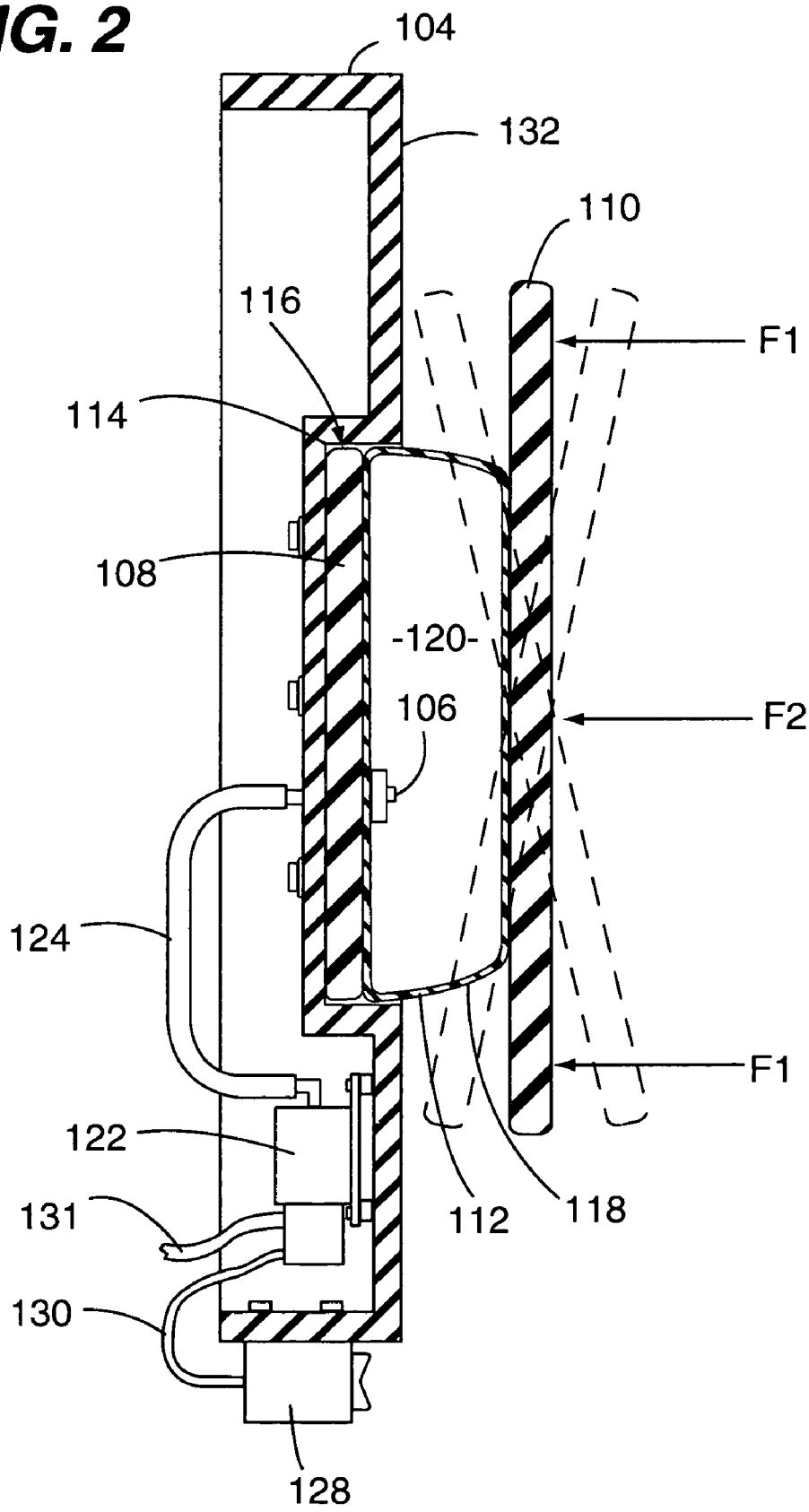
FIG. 2 is a cross sectional view taken along the line 2-2 in FIG. 1.

Referring now to FIGS. 1 and 2, the force application device 106 includes a substantially non-compliant base portion 108 (i.e., substantially rigid), a substantially non-compliant user contact portion 110 and a force transmission apparatus 112 coupled between the base portion 108 and the user contact portion 110. The base portion 108 is engaged within a closed end portion 114 of the foot platen 104 within an opening 116 thereof and the user contact portion 110 is configured for being engaged by a foot of the user. In one embodiment (shown), the base portion 108 and the user contact portion 110 are rigid plates made from a substantially rigid piece of material such as a piece of metal, wood or plastic, which can be attached to the force transmission apparatus 112 by any number of means. Examples of such means for attaching the base portion 108 and the user contact portion 110 to the force transmission apparatus 112 include, but are not limited to, mechanical fasteners, overmolding, adhesive bonding, thermal staking, ultrasonic welding and the like.

The force transmission apparatus 112 includes a compliant outer shell 118 and pressure displaceable material contained within a closed interior space 120 of the compliant outer shell 118. Examples of pressure displaceable materials include, but are not limited to, gaseous material such as air, granular material such as sand and foam material such as synthetic elastomeric foam. The compliant outer shell 118 can be made from a material such as a synthetic elastomeric material or any suitable material that causes the compliant outer shell 118 to exhibit instability (e.g., deflection, compression, displacement, etc) when subjected to an external load being exerted thereon.

The base portion 108 and the user contact portion 110 are coupled to each other by the compliant outer shell 118 such that, over an allowable range of motion of the user contact portion 110 with respect to the base portion 108, a user must simultaneously apply force on the user contact portion 110 for dictating relative orientation of the user contact portion 110 with respect to the base portion 108 and force for actuating the reactant force generating mechanism 102 of the leg press machine 100 (i.e., the exercise machine). More specifically, as shown in FIG. 2, the user exerts an aggregate force that includes a first force component F1 for dictating (i.e., controlling) the relative orientation of the user contact portion 110 with respect to the base portion 108 and a second force component F2 for actuating the reactant force generating mechanism 102 of the leg press machine 100. Advantageously, the first force component F1, which dictates the relative orientation of the user contact portion 110 with respect to the base portion 108, is predominately exerted by stabilizer muscles associated with the core and/or mover muscles that predominately provide the second force component F2. In this manner, with respect to a conventional stable force input structure, stabilizer muscles are exerted to a much higher proportion relative to associated core and/or mover muscles.

Attributes influencing instability of a force application device in accordance with the present invention (e.g., magnitude of stabilizer muscle engagement) include, but are not limited to, the material that the compliant outer shell is made from, the thickness of the compliant outer shell, the volume of pressure displaceable material within the interior space of the compliant outer shell, the type of pressure displaceable material within the interior space of the compliant outer shell and the shape of the compliant outer shell. Accordingly, by manipulating one or more of these attributes, the magnitude and/or rate at which instability is exhibited for a given amount of force exerted on the force transmission apparatus can be selectively varied.

Still referring to FIG. 2, a pneumatic pump 122 is coupled to the compliant outer shell 118 via a pneumatic conduit 124 (e.g., a hose or tube) and an inlet nipple 126. The inlet nipple extends through a wall of the compliant outer shell 118 in an airtight manner. The pump 122 is configured for pumping air (i.e., a gaseous material) into the interior space 120 of the compliant outer shell 118 such that at least a portion of the pressure displaceable material within the interior space 120 is a gaseous material. A pump control device 128 such as, for example, a two-position momentary rocker switch, is connected to the pump 122 via a cable 130 and allows air pressure within the compliant outer shell 118 to be selectively adjusted for altering the instability characteristics of the force transmission apparatus 112. With the pump control device 128 in a first state, the pump is energized via a power supply (not shown) connected to a power cable 131 of the pump 122 such that air pressure within the interior space 120 of the compliant outer shell 118 is increased by air being pumped into the interior space 120 through the pneumatic conduit 124 and the inlet nipple 126. With the pump control device 128 in a second state, an air-bleeding device (not specifically shown) of the pump 122 (e.g., a solenoid controlled air valve) is energized such that air pressure within the interior space 120 of the compliant outer shell 118 is reduced by air being released from within the interior space 120.

It is disclosed herein that, in one embodiment of the present invention, the foot platen 104 (i.e., a force input structure) and the force application device 106 can be jointly configured for allowing the force application device 106 to be selectively changed between a stowed configuration and a use configuration. In the use configuration, the user contact portion 110 and the compliant outer shell 118 are in the orientation substantially as shown in FIG. 2. In the stowed configuration, the user contact portion 110 is substantially flush with a top surface 132 of the foot platen 104. To this end, with respect to the stowed configuration, the compliant outer shell 118 and the opening 116 of the foot platen 104 are configured for allowing the pump 122 to deflate (e.g., collapse) the compliant outer shell 118 to a degree in which the user contact portion 110 retracts into a recess (not shown) in the top surface 132 of the foot platen 104. The recess would have a shape, size and depth that accommodates the user contact portion 110 to allow the user contact portion 110 to be flush with the top surface 132 when in the force application device 106 is in the stowed configuration. To permit such functionality, for example, the compliant outer shell 118 can include a bellow shaped portion that provides for extension and retraction of the user contact portion 110 with respect to the top surface 132 of the foot platen 104.

Figure 3:
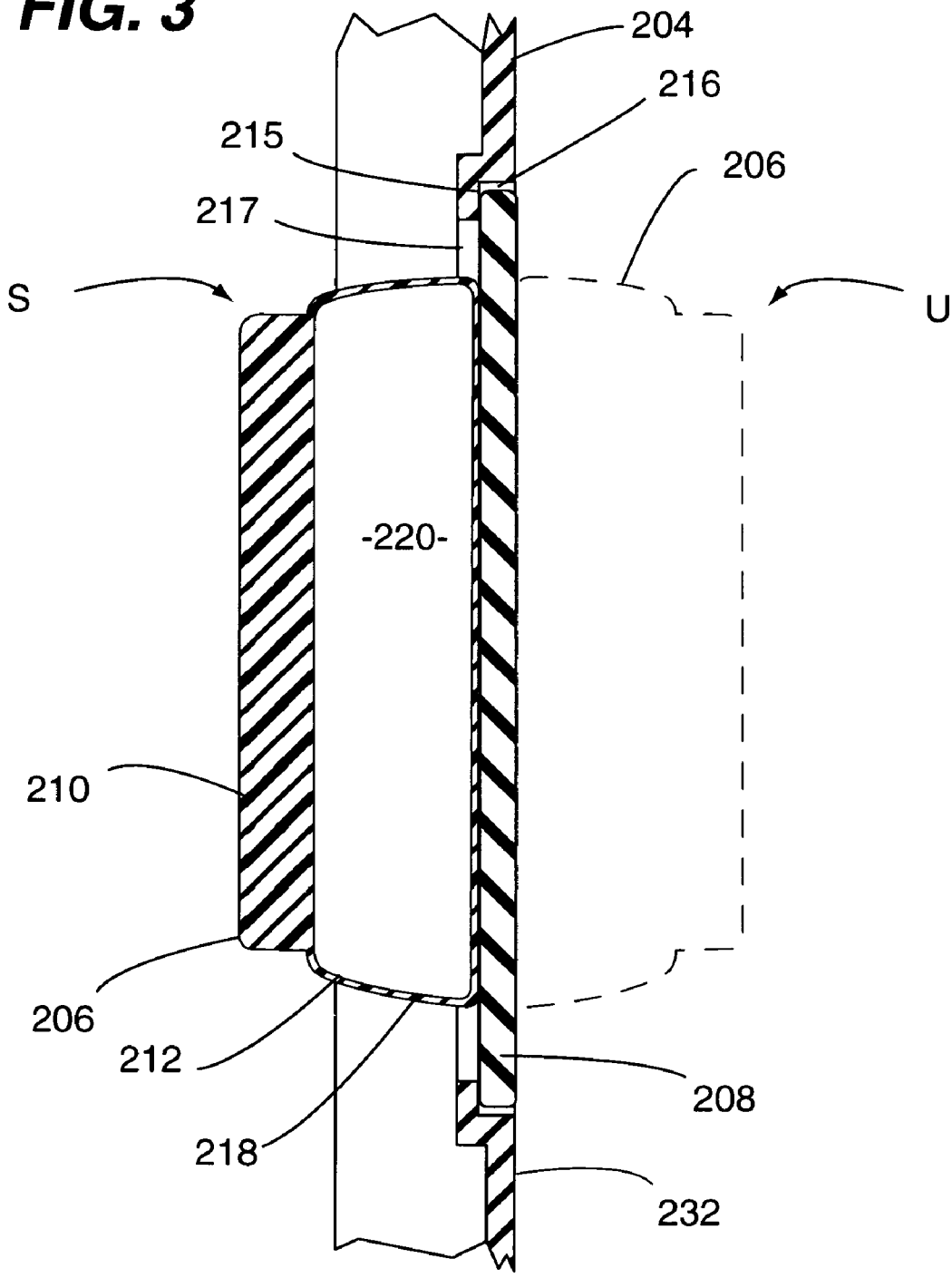
FIG. 3 is a cross sectional view of a manually stowable force application device configured in accordance with an embodiment of the present invention.

Referring now to FIG. 3, a manually stowable force application device 206 in accordance with an embodiment of the present invention is shown. The force application device 206 is positionable in use and stowed orientations with respect to a force input structure 204 of an exercise machine or apparatus. With respect to instability functionality, the force application device 206 is functions in the same overall manner as the force application device 106.

The force application device 206 includes a substantially non-compliant base portion 208, a substantially non-compliant user contact portion 210 and a force transmission apparatus 212 coupled between the base portion 208 and the user contact portion 210. The force transmission apparatus 212 includes a compliant outer shell 218 and pressure displaceable material contained within a closed interior space 220 of the compliant outer shell 218. Examples of pressure displaceable materials include, but are not limited to, gaseous material such as air, granular material such as sand and foam material such as synthetic elastomeric foam. The compliant outer shell 218 can be made from a material such as, for example, a synthetic elastomeric material or any suitable material that causes the compliant outer shell 218 to exhibit compliance (e.g., deflection, compression, displacement, etc) when subjected to an external load being exerted thereon. The base portion 208 is a rigid plate made from a material such as metal, wood or plastic, which can be attached to the force transmission apparatus 212 by any number of means. The substantially non-compliant user contact portion 210 is a suitably thickened portion of the compliant outer shell 218 (i.e., unitarily formed therewith).

The base portion 208 engages a shoulder 215 within an opening 216 of the force input structure 204. The shoulder 215 encompasses an aperture 217 within the force input structure 204. In the stowed orientation S, the base portion 208 is substantially flush with the top surface 232 of the force input structure 204 and the compliant outer shell 218 extends through the aperture 217. In the use orientation U, the base portion 208 is substantially flush with the top surface 232 of the force input structure 204 with the compliant outer shell 218 extending above the top surface 232 of the force input structure 204.

It is further disclosed herein that a force application device in accordance with the present invention can be pivotably coupled to a force input structure of an exercise machine or apparatus. Such pivoting can be about one or more axes and provided by a base portion of the force application device being pivotably coupled to the force input structure. Such pivoting serves to enhance the instability effect exhibited by a user actuating a reactance force mechanism by applying force on the force application device. More specifically, stabilizing force must be applied to stabilize not only the force transmission apparatus of the force application device, but also to stabilize the entire force application device with respect to the force input structure of the exercise machine or apparatus. Such pivoting functionality can be integrated into any embodiment of a force application device in accordance with the present invention.

Still further, it is disclosed herein that a force input structure (e.g., foot platen) configured in accordance with the present invention (i.e., incorporating one or more force application devices) can be rotatably attached to a reactant force generating mechanism of an exercise machine or apparatus. For example, the one or more force application devices can be offset from a horizontal centerline of the force input structure such that the one or more force application devices are in a use position (i.e., fully or partially below the horizontal centerline) when the force input structure is rotated to a first horizontal orientation and such that the one or more force application devices are in a non-use position use position (i.e., fully or partially above the horizontal centerline) when the force input structure is rotated to a second horizontal orientation (e.g., rotated 180 degrees with respect to the first horizontal orientation).

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An exercise machine, comprising:

a reactant force generating mechanism including a force input structure; and a force application device coupled to the force input structure and configured for transmitting force generated by a user and applied thereon to the force input structure, wherein at least a portion of the force application device protrudes from within an opening in the force input structure, wherein the force application device includes a substantially non-compliant base portion, a compliant outer shell coupled to said base portion and pressure displaceable material contained within an interior space of the compliant outer shell, wherein said pressure displaceable material includes at least one of gaseous material, granular material and foam material, wherein the force application device is configured for allowing said force generated by the user and applied on the compliant outer shell to be transmitted through said pressure displaceable material and exerted on the reactant force generating mechanism of the exercise machine so as to cause the force input structure to exert a proportional reactant force on the force application device, wherein the force application device includes a substantially non-compliant user contact portion configured for being engageable with a force exerting appendage of the user, and wherein said user contact portion is one of unitarily formed with and attached to the compliant outer shell.

2. The exercise machine of claim 1 wherein said force generated by the user and applied on the compliant outer shell is transmitted to the reactant force generating mechanism through pressure generated within said pressure displaceable material contained within the compliant outer shell such that the user must simultaneously apply force upon the force application device for dictating relative orientation of the user contact portion with respect to the base portion and for actuating the reactant force generating mechanism of the exercise machine.

3. The exercise machine of claim 2, further comprising:

a pump coupled to the compliant outer shell and configured in a manner for pumping gaseous material into the interior space of the compliant outer shell, wherein at least a portion of said pressure displaceable material within the interior space is gaseous material.

4. The exercise machine of claim 1 wherein:

the force input structure includes a shoulder within an opening thereof; and said base portion of the force application device rests upon the shoulder within the opening.

5. The exercise machine of claim 4 wherein:

the force application device includes a substantially non-compliant user contact portion configured for being engaged with a force exerting appendage of the user; and said user contact portion is one of unitarily formed with and attached to the compliant outer shell.

6. The exercise machine of claim 1, further comprising:

a pump coupled to the compliant outer shell and configured in a manner for pumping gaseous material into the interior space of the compliant outer shell, wherein at least a portion of said pressure displaceable material within the interior space is gaseous material.

7. The exercise machine of claim 1 wherein:

said force generated by the user and applied on the compliant outer shell is transmitted to the reactant force generating mechanism through pressure generated within said pressure displaceable material contained within the compliant outer shell thereby causing the user to simultaneously apply force upon the force application device for dictating relative orientation of the user contact portion with respect to the base portion and for actuating the reactant force generating mechanism of the exercise machine.

8. An exercise machine, comprising:

a reactant force generating mechanism including a force input structure configured for having force generated by a user exerted thereon; and a force application device coupled to the force input structure, wherein at least a portion of the force application device protrudes from within an opening in the force input structure, wherein the force application device includes a user contact portion configured for being engaged with a force exerting appendage of the user and a force transmission apparatus coupled between the reactant force generating mechanism and the user contact portion and wherein the reactant force generating mechanism and the user contact portion are coupled to each other by a compliant outer shell of the force transmission apparatus such that, over an allowable range of motion of the user contact portion with respect to the force input structure, the user must simultaneously apply force on the user contact portion for dictating relative orientation of the user contact portion with respect to the force input structure and for actuating the reactant force generating mechanism of the exercise machine.

9. The exercise machine of claim 8 wherein:

the force transmission apparatus includes a compliant outer shell having an interior space and pressure displaceable material contained within the interior space; and said pressure displaceable material includes at least one of gaseous material, granular material and foam material.

10. The exercise machine of claim 9 wherein:

the user contact portion is substantially non-compliant; and said user contact portion is one of unitarily formed with and attached to the compliant outer shell.

11. The exercise machine of claim 10, further comprising:

a pump coupled to the compliant outer shell and configured in a manner for pumping gaseous material into the interior space of the compliant outer shell, wherein at least a portion of said pressure displaceable material within the interior space is gaseous material.

12. A force input structure for an exercise machine, wherein the force input structure has a force application device in combination therewith, wherein the force application device is configured for allowing force generated by a user and applied thereon to be exerted on the force input structure of a reactant force generating mechanism of the exercise machine so as to cause a reactant force generating mechanism of the exercise machine to exert a proportional reactant force on the force application device via the force input structure, wherein at least a portion of the force application device protrudes from within an opening in the force input structure, the force application device, comprising:

a substantially non-compliant base portion having a machine interface portion coupled to the force input structure of the exercise machine;

a substantially non-compliant user contact portion configured for being engaged with a force exerting appendage of the user; and a force transmission apparatus coupled between said base portion and said user contact portion, wherein the force transmission apparatus includes a compliant outer shell and pressure displaceable material contained within an interior space of the compliant outer shell, wherein said base portion and said user contact portion are coupled to each other by the compliant outer shell such that, over an allowable range of motion of the user contact portion with respect to the force input structure, the user must simultaneously apply force on said user contact portion for dictating relative orientation of said user contact portion with respect to the force input structure and for actuating the reactant force generating mechanism of the exercise machine.

13. The force input structure of claim 12 wherein said pressure displaceable material includes at least one of gaseous material, granular material and foam material.

14. The force input structure of claim 13 wherein said user contact portion is one of unitarily formed with and attached to the compliant outer shell.

15. The force input structure of claim 14, further comprising:

a pump coupled to the compliant outer shell and configured in a manner for pumping gaseous material into the interior space of the compliant outer shell, wherein at least a portion of said pressure displaceable material within the interior space is gaseous material.

16. An exercise machine, comprising:

a reactant force generating mechanism, a foot platen coupled to the reactant force generating mechanism such that force exerted on the foot platen by a user causes the reactant force generating mechanism to exert a proportional reactant force on the foot platen;

a stabilizer muscle activating force application device coupled to the foot platen in a manner whereby the stabilizer muscle activating force application device is accessible by the user when the user is in a use position with respect to the foot platen, wherein at least a portion of the stabilizer muscle activating force application device protrudes from within an opening in the foot platen and wherein the stabilizer muscle activating force application device comprises:

a substantially non-compliant base portion engaged with the foot platen;

a substantially non-compliant user contact portion configured for being engaged by a foot of the user; and a force transmission apparatus coupled between said base portion and the user contact portion, wherein the force transmission apparatus includes a compliant outer shell and pressure displaceable material contained within an interior space of the compliant outer shell, wherein said pressure displaceable material includes at least one of gaseous material, granular material and foam material, wherein said base portion and said user contact portion are coupled to each other by the compliant outer shell such that, over an allowable range of motion of said user contact portion with respect to said base portion, the user must simultaneously apply force on said user contact portion for dictating relative orientation of said user contact portion with respect to said base portion and for actuating the reactant force generating mechanism of the exercise machine.

17. The exercise machine of claim 16, further comprising:

a pump coupled to the compliant outer shell and configured in a manner for pumping gaseous material into the interior space of the compliant outer shell, wherein at least a portion of said pressure displaceable material within the interior space is gaseous material.

* * * * *